US009058940B2

(12) United States Patent
Borg

(10) Patent No.: US 9,058,940 B2
(45) Date of Patent: Jun. 16, 2015

(54) CUTOUT SWITCH OR CHANGEOVER SWITCH HAVING BREAKABLE PERMANENT ELECTRICAL JUNCTION

(75) Inventor: Evrard Borg, Martignas sur Jalle (FR)

(73) Assignee: HERAKLES, Le Haillan (FR)

( * ) Notice: Subject to any disclaimer, the term of this patent is extended or adjusted under 35 U.S.C. 154(b) by 199 days.

(21) Appl. No.: 13/512,226

(22) PCT Filed: Nov. 26, 2010

(86) PCT No.: PCT/FR2010/052545

§ 371 (c)(1),
(2), (4) Date: Aug. 6, 2012

(87) PCT Pub. No.: WO2011/064510

PCT Pub. Date: Jun. 3, 2011

(65) Prior Publication Data

US 2013/0126326 A1 May 23, 2013

(30) Foreign Application Priority Data

Nov. 27, 2009 (FR) ..... 09 58446

(51) Int. Cl.

| | |
|---|---|
| ***H01H 85/00*** | (2006.01) |
| ***H01H 15/06*** | (2006.01) |
| *H01H 39/00* | (2006.01) |

(52) U.S. Cl.

CPC ..... *H01H 15/06* (2013.01); *H01H 39/004* (2013.01); *H01H 39/006* (2013.01)

(58) Field of Classification Search

USPC ..... 200/61.03, 61.08, 82 R; 337/31, 157
IPC ..... H01H 39/006
See application file for complete search history.

(56) References Cited

U.S. PATENT DOCUMENTS

2010/0328014 A1* 12/2010 Suzuki et al. ..... 337/30

FOREIGN PATENT DOCUMENTS

| | | |
|---|---|---|
| GB | 2 352 879 | 2/2001 |
| JP | 63-165747 U | 10/1988 |
| JP | 11-232978 | 8/1999 |
| JP | 2000-315447 | 11/2000 |
| WO | WO 96/19816 | 6/1996 |
| WO | WO 97/41582 | 11/1997 |

* cited by examiner

*Primary Examiner* — Vanessa Girardi
(74) *Attorney, Agent, or Firm* — Hamre, Schumann, Mueller & Larson, P.C.

(57) ABSTRACT

The present invention relates to an electric switch having a hollow body defining a cavity, an actuator, and a slide mounted in said cavity. Under the action of the actuator, the slide is suitable for passing from a first position, in which at least one conductive portion of the slide is electrically connected via permanent breakable electrical junctions to at least two primary electrically-conductive studs that lead laterally into said cavity to a second position in which at least one of said primary electrically-conductive studs is no longer electrically connected to said conductive portion of the slide.

23 Claims, 5 Drawing Sheets

CUTOUT SWITCH OR CHANGEOVER SWITCH HAVING BREAKABLE PERMANENT ELECTRICAL JUNCTION

The present invention relates to an electric switch.

More particularly, the invention relates to an electric switch having a "slide" and in particular an electric switch of the type comprising a hollow body defining a cavity, an actuator arranged in the cavity, a slide mounted in the cavity downstream from the actuator and including at least one conductive portion, and at least two primary electrically-conductive studs installed in the thickness of the hollow body and leading laterally into the cavity, the conductive portion of the slide and the two primary electrically-conductive studs being electrically connected together when the slide is in a first position, thereby closing a first electric circuit, and the slide being suitable, under the action of the actuator, for passing from its first position to a second position in which at least one of said primary electrically-conductive studs is no longer electrically connected to said conductive portion of the slide.

The electric switch of the present description may be used as a cutout switch or as a changeover switch, depending on the embodiment. It is particularly suitable for high-current electric circuits.

In numerous applications, it is necessary to have electric switches that are fast and reliable for opening a faulty circuit in order to isolate one or more components, in particular when they have failed, and also making it possible, where appropriate, to act simultaneously to close a branch circuit.

Document FR 2 788 165 describes an example of an electric switch of the above type in which electrically-conductive studs passing through the thickness of the hollow body are clamped by screw-tightener means against the conductive portion of a slide mounted to move inside the hollow body. That connection by screw-fastening does not serve to ensure that the electrical contacts made between the slide and the conductive studs are sufficiently reliable. Under the effect of external stresses (vibration, impacts, . . . ), the screw-fastened connection may loosen, thereby leading to bad contacts, to electric arcing, and to other unwanted phenomena.

In addition, the electric switch described in document FR 2 788 165 requires the use of precision components that are relatively expensive and requires those components to be adjusted very accurately during assembly.

An object of the present invention is to provide an electric switch that avoids the above-mentioned drawbacks.

In particular, an object of the present invention is to provide an electric switch forming a changeover switch, capable of being assembled very simply and capable of responding very fast, while providing electrical connections that are reliable.

In a first embodiment of the present invention, this object is achieved by means of a switch of the above-specified type comprising a hollow body defining a cavity, an actuator arranged in said cavity, a slide mounted in said cavity downstream from said actuator and including at least one conductive portion, first and second electrically-conductive studs forming a first pair, and a downstream electrically-conductive stud arranged downstream from said first pair, wherein said electrically-conductive studs are arranged in the thickness of the hollow body and lead laterally into the cavity, wherein the conductive portion of the slide and the two electrically-conductive studs of the first pair are electrically connected together when the slide is in a first position, thereby closing a first electric circuit, wherein the slide is suitable for passing from its first position to a second position under the action of the actuator, wherein the conductive portion of the slide includes a first projection situated upstream from the first electrically-conductive stud of the first pair, and a second projection situated upstream from the downstream electrically-conductive stud, and wherein, when the slide is in its second position, the first and second projections are arranged to clamp respectively against the junction facets of the first electrically-conductive stud of the first pair and of the downstream electrically-conductive stud.

Another object of the present invention is to provide an electric switch suitable for being assembled very simply, suitable for acting very fast, and providing electrical connections that are reliable.

In a first embodiment, this object is achieved by means of an electric switch of the above-specified type, wherein the connection between the conductive portion of the slide and the two primary electrically-conductive studs is a breakable permanent electrical junction constituted by a weld.

In an embodiment of the invention, this object is also achieved by means of an electric switch of the above-specified type, wherein the connection between the conductive portion of the slide and the two electrically-conductive studs is a breakable permanent electrical junction constituted by a braze or solder joint.

By means of these arrangements, when the slide is in its first position, the electrically-conductive studs are electrically connected together, thereby closing a first electric circuit. In this position, this first electric circuit is closed by electrical contacts that are reliable. Since the connections between the primary electrically-conductive studs and the conductive portion of the slide are permanent electrical junctions, electrical contact between these elements is provided even in the event of the electric switch being subjected to vibration or to impacts. Undesirable phenomena such as bad contacts, Joule effect losses, electric arcing, etc., are avoided. The switch provides a cutout function: when, under the action of the actuator, the slide passes from its first position to its second position, at least one of the studs is no longer electrically connected to the conductive portion of the slide. The electrical connection between the two primary electrically-conductive studs is broken, and the first electric circuit is open.

Furthermore, brazing or soldering, like welding, is inexpensive to perform.

Another object of the present invention is to provide an electric switch suitable for being assembled very simply, and capable of breaking electrical connections very quickly and thus of being actuated very fast.

In an embodiment of the present invention, this object is achieved by means of an electric switch of the above-specified type, wherein the junction facet of at least one electrically-conductive stud and the corresponding junction facet of the conductive portion diverge downstream.

Advantageously, each junction facet of each primary electrically-conductive stud and the corresponding junction facet of the conductive portion diverge downstream.

Such a configuration enables the slide, on passing from its first position to its second position, to disengage immediately from the primary electrically-conductive studs without being impeded by friction. This reliably cuts out the first electric circuit connecting together the electrically-conductive studs, thus making it possible to avoid electric arcing.

Throughout the present application (and in particular for all of the embodiments described), the term "primary electrically-conductive studs" is used to designate electrically-conductive studs that are connected to the conductive portion of the slide when the slide is in its first position, i.e. when the electric switch is in its initial state.

Several embodiments are described in the present description. Nevertheless, unless specified to the contrary, the characteristics described with reference to any one embodiment may be applied to any other embodiment.

Other characteristics and advantages of the invention appear on reading the following description of embodiments of the invention given by way of non-limiting illustration. The description refers to the accompanying sheets of drawings, in which.

Figure 1:
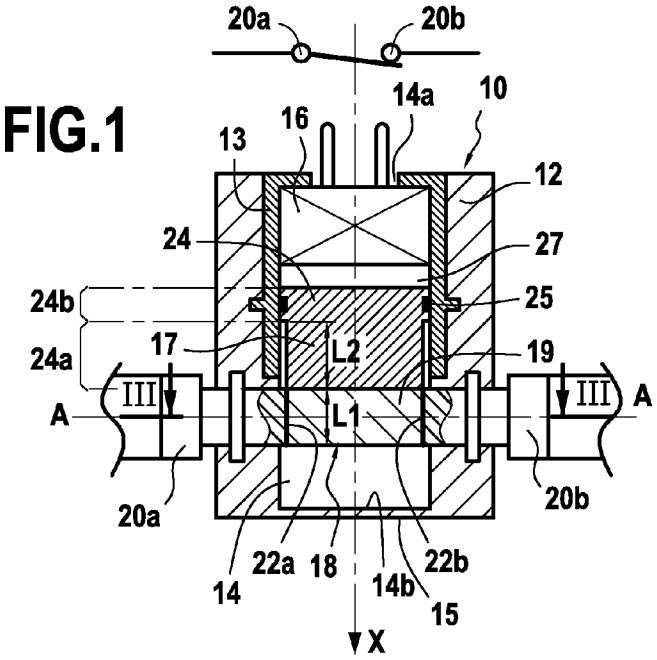
FIGS. 1 and 2 are lateral section views of an electric switch showing a first embodiment of the invention, in its first and second positions, respectively.

In the examples shown, the electric switch of the invention comprises a hollow body 12 defining an internal cavity 14 of circular section that is closed at its bottom end 14*b* by a bottom wall 15, and lined in part, in its upper portion, by a jacket 13. In other embodiments, the cavity 14 could naturally present a cross-section that is rectangular or of any other appropriate shape.

In the present description, and unless stated to the contrary, an axial direction is a direction parallel to the main axis X of the cavity 14 of the hollow body 12. In addition, a radial direction is a direction perpendicular to the main axis X of the cavity 14 and intersecting said axis. Unless specified to the contrary, the adjectives and adverbs "axial", "radial", "axially", and "radially" are used with reference to the above-specified axial and radial directions. In the same way, an axial plane is a plane containing the main axis X of the cavity 14 and a radial plane is a plane perpendicular to said axis. Similarly, an axial section is a section defined in an axial plane, and a radial section is a section defined in a radial plane.

In addition, unless specified to the contrary, the adjectives "top" and "bottom" are used with reference to the orientation of the axis X as shown in the figures.

Finally, the terms "upstream" and "downstream" are defined relative to the direction of movement inside the cavity 14 along the axis X of the slide 18 as described below.

The electric switch has a pyrotechnic gas generator 16 (e.g. a micro gas generator together with its pyrotechnic initiator, or a pyrotechnic initiator on its own, depending on the quantity of gas that needs to be supplied in order to operate the switch), which gas generator serves to close the cavity 14 at its top end 14*a*. In the examples, the electric switch 10 is thus a single-operation switch.

As shown in the figures, electrically conductive studs are installed in the thickness of the hollow body and open out laterally into the cavity 14. Each of these conductive studs has a junction facet facing towards the inside of the cavity 14.

A slide 18 having a conductive portion 19 is mounted in the cavity 14 downstream from the pyrotechnic gas generator 16. The conductive portion 19 of the slide 18 is initially connected to at least two primary electrically conductive studs, thereby closing a first electric circuit.

Upstream from its conductive portion 19, the slide 18 has a non-conductive portion 24 with at least one segment 24*b* that presents a section complementary to the section of the cavity 14 and that forms a piston suitable for sliding inside the jacket 13 along the axial direction X.

In the examples described, the conductive portion 19 is connected to the non-conductive portion 24. In a variant, it is also possible for the conductive portion 19 and the piston 24 to be independent of each other.

As shown in FIG. 1, a gas expansion chamber 27 is provided between the pyrotechnic gas generator 16 and the piston 24.

In addition, the piston 24 is provided at its periphery with at least one groove suitable for receiving a sealing ring 25 for providing sealing between the gas expansion chamber 27 and the remainder of the cavity 14.

Any other sealing means could be used instead of a sealing ring 25. By way of example, the gas expansion chamber could be sealed by injecting a plastics material into an annular groove of the piston 24, which plastics material is more malleable than the material used for making the piston. Sealing may also be obtained by a succession of baffles made on the piston 24 and serving to reduce the leakage rate of gas passing through the gap that exists between the piston 24 and the inside wall of the cavity 14.

It should be observed that a gas leakage orifice (not shown) may be provided in the downstream portion of the cavity 14, e.g. in its bottom wall 15.

When the electricity-passing flow sections between the primary electrically-conductive studs and the conductive portion 19 of the slide 18 are small, the forces due to the pressure of gas inside the combustion chamber 27 and that suffice to break the connections between the electrically-conductive studs and the slide 18 are relatively moderate. Under such circumstances, and by way of example, a hollow body 12 made of polymer reinforced by an injection method has sufficient mechanical strength.

When the required forces are greater, the hollow body 12 may be reinforced by a metal strength member. In one embodiment, the metal strength member may surround the hollow body 12 so as to form a rigid protective shell. In another example, when the hollow body 12 is made by an injection method, the metal strength member may be inserted directly in the material at the time of injection.

If such a reinforcing strength member is used, the pyrotechnic gas generator 16 and the electrically-conductive studs generally need to be mounted in insulating jackets that are fitted to the body.

As mentioned above, in the variant embodiment shown, the electric switch has a pyrotechnic gas generator 16. It should be observed that this example is not limiting and that it is possible to use any other device or actuator capable of exerting sufficient force on the top portion of the slide 18 to break the connection between the electrically-conductive studs and the slide 18. For example, it is possible to use actuators operating on mechanical or electrical energy.

An example of the operation of the above-described switch is as follows:

When the pyrotechnic gas generator 16 is actuated under the effect of an electric trigger signal, e.g. transmitted by a unit (not shown) for detecting a fault in an electrical component of the first electric circuit, combustion gas is released into the expansion chamber 27 situated upstream from the piston 24.

As the gas pressure increases inside the expansion chamber, the connections between the primary electric studs and the slide 18 are subjected to ever-increasing shear forces. Finally, when the forces due to the gas pressure exceed the shear strength of those connections, they break, thereby releasing the slide 18, which then moves downstream until it comes against the abutment formed by the bottom wall of the cavity 14, for example.

Figure 2:
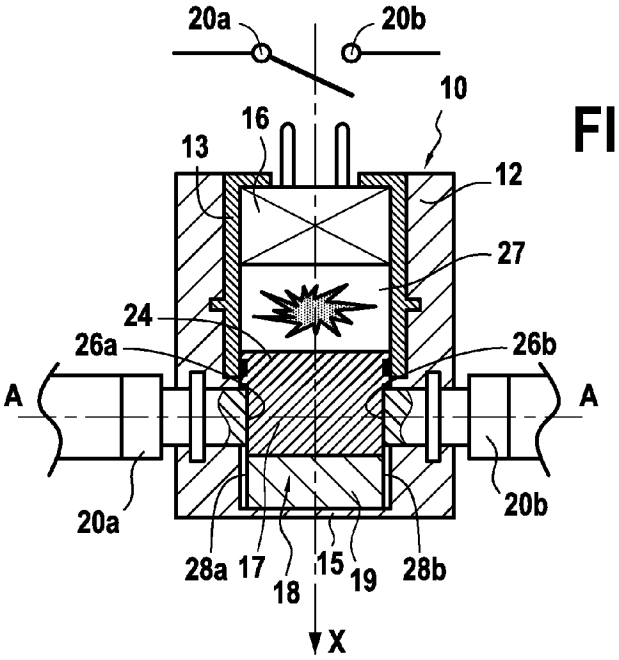

In FIGS. 1 and 2, an electric switch 10 is shown that constitutes a first embodiment of the invention. In this first embodiment, the electric switch 10 has a cutout function for a first electric circuit interconnecting two electrically-conductive studs 20*a* and 20*b* that penetrate into the cavity 14.

In this example, the two electrically-conductive studs 20*a* and 20*b* are arranged on a common radial axis A-A, and each has a junction facet 26*a* or 26*b* that is defined in a plane perpendicular to the axis A-A and facing towards the inside of the cavity 14.

In this example, the slide 18 has a non-conductive portion (made of insulating material) provided both with a first segment 24*b* presenting a section that is complementary to the section of the cavity 14 and forming a piston, and downstream from said first segment 24*b*, also with a second segment 24*a* of axial length L2.

Downstream from this non-conductive portion 24, the slide also has a conductive portion 19 that, in this example, presents a length (measured in the axial direction X) that is substantially equal to the length L1 of the junction facets 26*a* and 26*b* of the conductive studs 20*a* and 20*b*.

As shown in FIG. 1, the junction facet 26*a* of the first electrically-conductive stud 20*a* is connected to a corresponding junction facet 28*a* of the conductive portion 19 by a bond 22*a*, e.g. obtained by welding with a tin-copper alloy.

In the same manner, the junction facet 26*b* of the second primary electrically-conductive stud 20*b* is connected to a corresponding junction facet 28*b* of the conductive portion 19 by a bond 22*b*, e.g. obtained by welding with a tin-copper alloy.

By means of the two welds 22*a* and 22*b*, a first electric circuit is closed between the first and second primary electrically-conductive studs 20*a* and 20*b*, which studs are connected together via the conductive portion 19 of the slide 18.

The welds 22*a* and 22*b* are capable of withstanding external stresses such as vibration, impacts, etc., and thereby serve to ensure electrical contact that is reliable.

When the pyrotechnic gas generator 16 is actuated under the effect of an electric trigger signal, e.g. transmitted by a unit (not shown) for detecting a fault in an electrical component of the first electric circuit, combustion gas is released into the expansion chamber 27 situated upstream from the piston 24.

As the gas pressure increases inside the expansion chamber, the welds 22*a* and 22*b* are subjected to ever-increasing shear forces. Finally, when the force due to the gas pressure exceeds the shear strength of the welds 22*a* and 22*b*, the welds 22*a* and 22*b* break, thereby releasing the slide 18, which moves downstream until it comes into abutment against the bottom wall of the cavity 14. The stroke traveled by the slide 18 between its first position and its second position is longer than the axial length L1 of the conductive portion 19.

In the second position of the slide 18, shown in FIG. 2, the junction facets 28*a* and 28*b* and the entire conductive portion 19 are located downstream from the junction facets 26*a* and 26*b* of the primary electrically-conductive studs 20*a* and 20*b*. The junction facets 26*a* and 26*b* are then situated facing the insulating portion 24 of the slide, such that the electrical connection between the studs 20*a* and 20*b* is broken and the first electric circuit is open.

It should be observed that in another embodiment, the conductive portion 19 may extend upstream from the electrically-conductive studs 20*a*, 20*b*. Under such circumstances, in order to enable the electric circuit to be interrupted cleanly and reliably when the slide goes from its first position to its second position, the conductive portion also presents a setback upstream from each of the electrically-conductive studs, such that after the pyrotechnic gas generator 16 has been actuated and the slide 18 has moved, each primary electrically-conductive stud 20*a*, 20*b* is positioned facing a setback, and the primary electric circuit is open.

Figure 3:
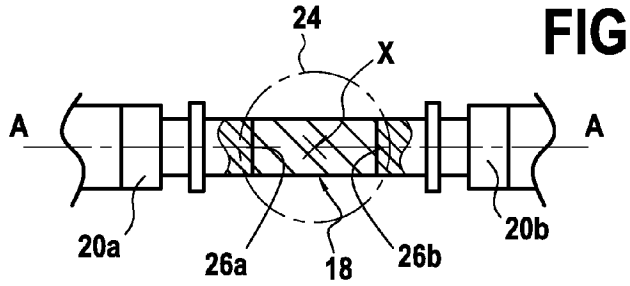
FIG. 3 is a cross-section on III-III of the FIG. 1 electric switch.

In the example of FIGS. 1 and 2, the conductive portion 19 is substantially in the form of a rectangular block. Its rectangular axial section is shown in FIG. 3. The junction facets 28*a* and 28*b* of the conductive portion 19 of the slide 18 are therefore plane, as are the corresponding facets 26*a* and 26*b* of the primary electrically-conductive studs 20*a* and 20*b*.

Figure 4:
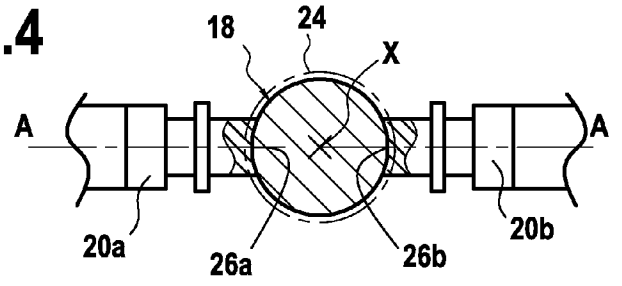
FIG. 4 shows a variant embodiment of the slide.

In another embodiment, the conductive portion 19 may present an axial section that is circular, as shown in FIG. 4. Under such circumstances, its junction facets 28*a* and 28*b* are convex in shape while the corresponding junction facets 26*a* and 26*b* of the electrically-conductive studs 20*a* and 20*b* have a corresponding concave shape.

In a second embodiment of the invention, the junction facets of the conductive portion 19 and of the primary electrically-conductive studs 20*a* and 20*b* are connected together by brazing. All of the characteristics, remarks, and variants mentioned above for the first embodiment of the invention remain valid with this second embodiment, and are therefore not repeated here.

Figure 5:
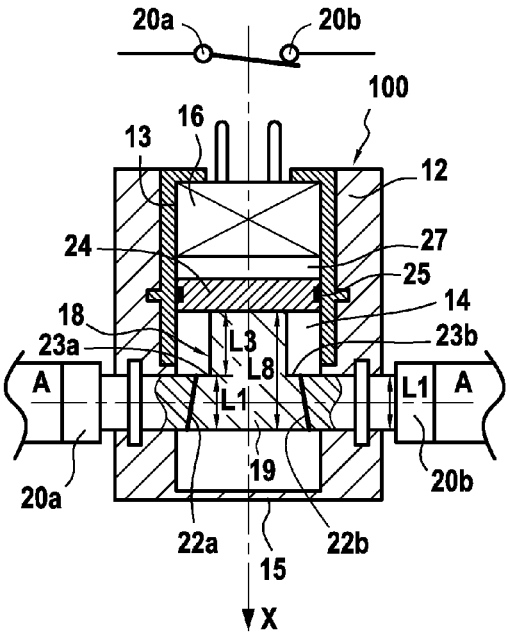
FIGS. 5 and 6 are lateral section views of an electric switch in a third embodiment shown in its first and second positions, respectively.
Figure 6:
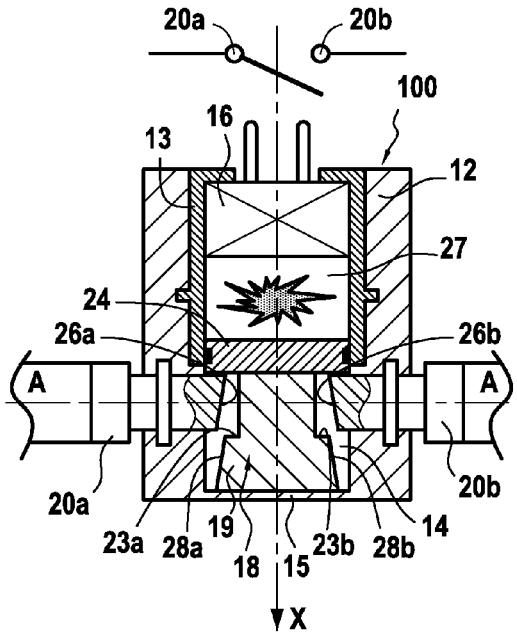

In FIGS. 5 and 6, there is shown an electric switch 100 in a third embodiment of the invention.

In this third embodiment, the electric switch 100 has a cutout function for a first electric circuit connecting together two electrically-conductive studs 20*a* and 20*b* leading into the cavity 14.

Numerical references corresponding to elements in common with the first and second embodiments as described above remain identical in the description below.

In this example, two electrically-conductive studs 20*a* and 20*b* project laterally into the inside of the cavity 14. These studs lie on a common radial axis A-A, and each of them has a junction facet 26*a*, 26*b* facing towards the inside of the cavity 14.

A slide 18 is mounted directly downstream from the pyrotechnic gas generator 16. In this example, the slide has a non-conductive portion (made of an insulating material) of section that is complementary to the section of the cavity 14 and that forms a piston, which piston is extended downstream by a conductive portion 19 of axial length L8 greater than the length L1 of the junction facets of the electrically-conductive studs 20*a*, 20*b*.

As shown in FIG. 5, when the slide 18 is in its first position, the two electrically-conductive studs 20*a* and 20*b* are electrically connected together via the conductive portion 19, thereby closing an electric circuit.

As shown in FIG. 5, the junction facets 26*a* and 26*b* of the electrically-conductive studs 20*a* and 20*b*, and the corresponding junction facets 28*a* and 28*b* of the slide 18 diverge going downstream.

In this example, upstream from each of its junction facets, the conductive portion 19 also includes a setback 23*a* or 23*b* extending over an axial length L3. The length L3 is selected to be greater than the length L1 of the conductive studs, and more generally to be such that after the pyrotechnic gas generator 16 has been actuated and the slide 18 has been moved, each electrically-conductive stud 20*a* and 20*b* is positioned facing a setback 23*a* or 23*b*.

Because of the setbacks 23*a* and 23*b* and also because of the slope of the junction facets 26*a*, 26*b*, 28*a*, and 28*b*, the slide 18 separates immediately from the two primary electrically-conductive studs 20*a* and 20*b* without being impeded by friction when it moves inside the cavity 14. The electrical connection between the conductive studs is broken very reliably and the electric circuit is interrupted cleanly. Furthermore, because of these arrangements, the breaking of the electrical connection between the primary electrically-conductive studs 20*a*, 20*b* and the conductive portion 19 is obtained for a minimum stroke of the slide 18 along the sliding direction X.

In a variant embodiment, the entire portion of the slide 18 that is situated upstream from the junction facets 28*a* and 28*b* may be made of an insulating material. Under such circumstances, the slide 18 does not necessarily include setbacks 23*a*, 23*b* upstream from the junction facets 28*a*, 28*b*.

Figure 16:
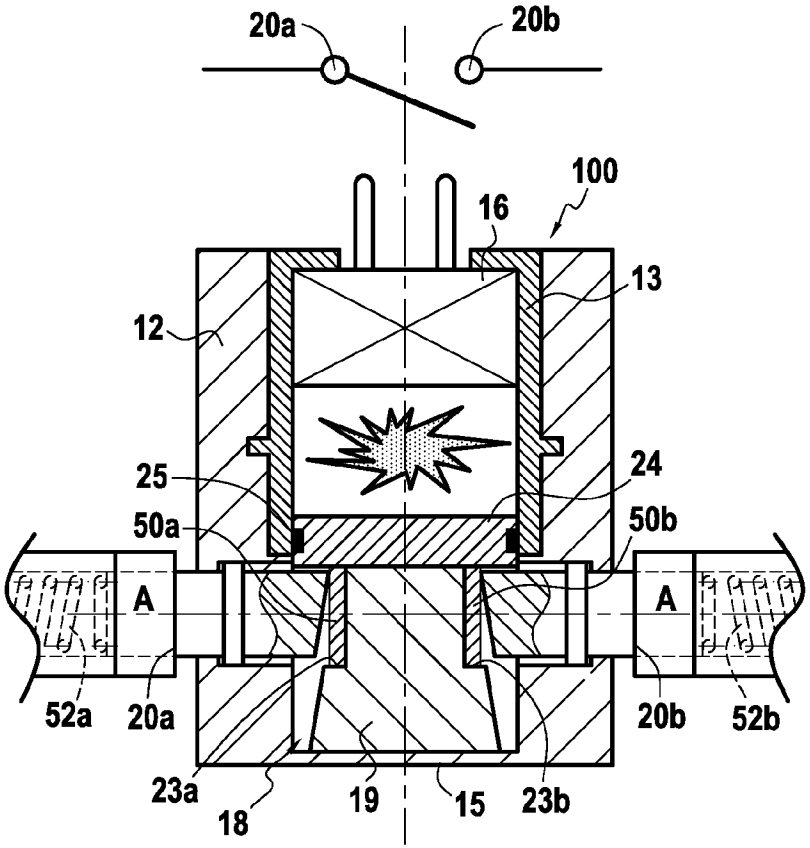
FIGS. 15 and 16 show a variant of the third embodiment of the invention shown in FIGS. 5 and 6.
Figure 15:
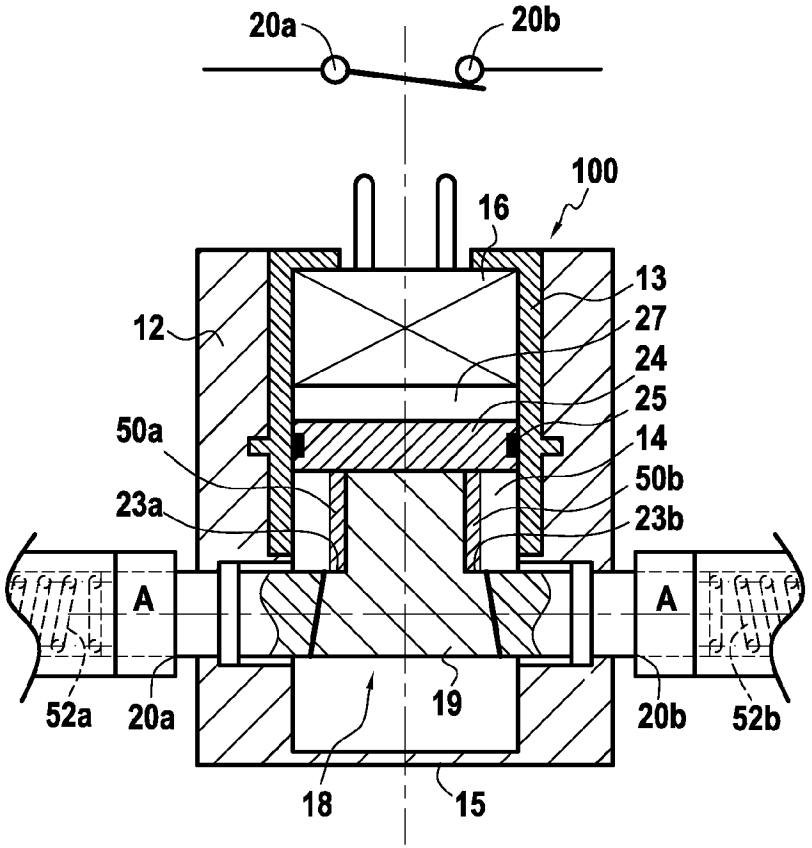

In yet another variant embodiment, an insulating strip is merely provided on each of the faces of the slide 18 situated upstream from a junction facet 28*a*, 28*b* (e.g. an insulating material fills the space formed by each setback 23*a*, 23*b*, see FIGS. 15 and 16).

As in the example shown, the junction facets 26*a*, 26*b*, 28*a*, and 28*b* of the primary electrically-conductive studs 20*a*, 20*b* and of the slide 18 preferably present a radial section that is rectilinear. Nevertheless, in a variant, these facets could present sections that are not rectilinear, providing, overall, they diverge going downstream.

In this embodiment, it should be observed that the junctions between the electrically-conductive studs 20*a*, 20*b* and the conductive portion 19 may be constituted by any type of breakable permanent electrical junction. In particular these junctions may be constituted by brazing, soldering or welding. Alternatively, the primary electrically-conductive studs 20*a*, 20*b* and the conductive portion 19 of the slide 18 may be made as a single part, being mutually defined by break starters.

In another variant embodiment shown in FIGS. 15 and 16, the primary electrically-conductive studs may be urged into contact with the conductive portion by resilient bias means, e.g. springs. Under such circumstances, the slide 18 advantageously includes an insulating portion 50*a*, 50*b* upstream from each junction facet 28*a*, 28*b* of the conductive portion 19. When the slide 18 is in its second position, the primary electrically-conductive studs 20*a*, 20*b* as urged towards the slide 18 by the springs 52*a*, 52*b*, and come into contact with said insulating portions 50*a*, 50*b*. The electrical connection between the primary electrically-conductive studs 20*a*, 20*b* is thus broken reliably in spite of the fact that these studs are urged towards the slide 18 by the springs 52*a*, 52*b*.

In the example shown, a strip of insulating material 50*a*, 50*b* is merely fitted on the slide 18 upstream from each junction facet 28*a*, 28*b* of the conductive portion 19. In particular, in FIGS. 15 and 16, the slide 18 has a setback 23*a*, 23*b* upstream from each junction facet 28*a*, 28*b*, and each setback 23*a*, 23*b* receives a strip of insulating material for being in register with a respective electrically-conductive stud when the slide is in its second position. In another embodiment, the slide 18 may include a segment of insulating material upstream from its conductive portion 19.

The above remarks relating to the variant shown in FIGS. 15 and 16 are applicable to all embodiments of the invention in which the electrical connection between at least one primary electrically-conductive stud and a conductive portion of the slide is obtained by resilient bias means, e.g. a spring.

Figure 7:
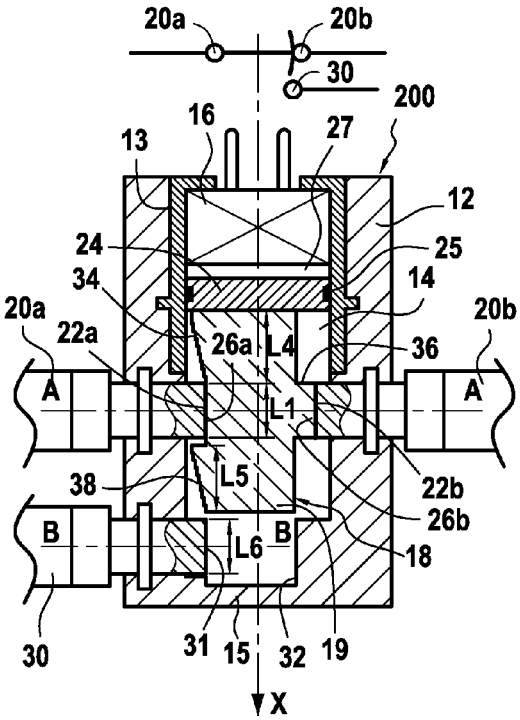
FIGS. 7 and 8 are lateral section views of an electric switch in a fourth embodiment of the invention, shown in its first and second positions, respectively.
Figure 8:
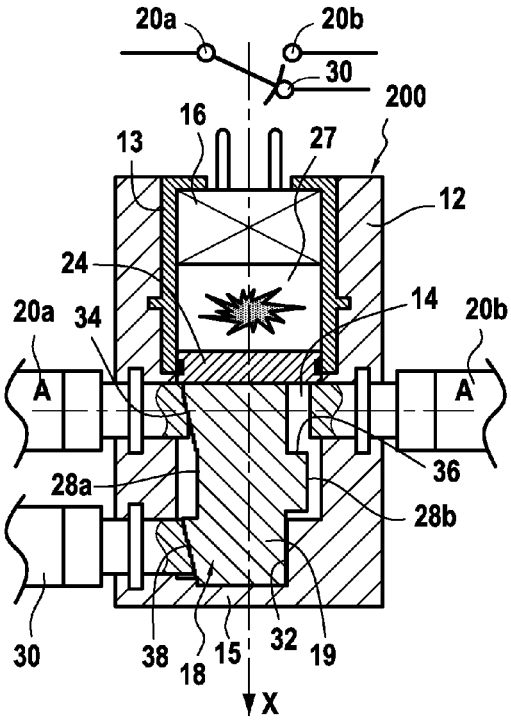

FIGS. 7 and 8 show an electric switch 200 in a fourth embodiment of the invention.

Numerical references that correspond to elements that are common with the above-described first, second, and third embodiments remain identical in the description below.

As shown in FIG. 7, the switch 200 has first and second primary electrically-conductive studs 20*a* and 20*b* that form a first pair, and a third electrically-conductive stud 30 that is situated downstream from the first stud pair (i.e. in a radial plane situated downstream from the plane in which the electrically-conductive studs 20*a* and 20*b* of the first pair are arranged), which stud is therefore referred to as the "downstream" conductive stud in the description below.

In this fourth embodiment, the electric switch 200 has a changeover function. For example, it is intended to isolate a faulty component connected to the second primary electrically-conductive stud 20*b* by opening the first electric circuit connecting together the primary electrically-conductive studs 20*a* and 20*b*, while closing a second electric circuit (branch circuit) between the first primary electrically-conductive stud 20*a* and the downstream electrically-conductive stud 30.

As shown in FIGS. 7 and 8, the switch has a slide 18 mounted in the cavity 14 downstream from the pyrotechnic gas generator 16. The slide 18 has a conductive portion 19 having its top end connected to an insulating portion 24 of section complementary to the section of the cavity 14 and constituting a piston.

When the switch 200 is in its initial position (i.e. its first position), the two primary electrically-conductive studs 20*a* and 20*b* are electrically connected together via the conductive portion 19 of the slide 18, so as to close a first electric circuit.

In this example, the junction facet 26*a* of the first electrically-conductive stud is connected to the corresponding junction facet 28*a* of the conductive portion 19 via a weld 22*a*. In the same manner, the junction facet 26*b* of the second electrically-conductive stud is connected to the corresponding junction facet 28*b* of the conductive portion 19 by a weld 22*b*.

More generally, the first and second primary electrically-conductive studs 20*a* and 20*b* may be connected to the conductive portion 19 by any breakable permanent electrical junction. For example, the junction may be provided by brazing. Alternatively, the primary electrically-conductive studs 20*a*, 20*b* and the conductive portion 19 of the slide may be made as a single part, being mutually defined by break starters. In another variant embodiment, the electrically-conductive studs may be urged into contact with the conductive portion by resilient bias means, e.g. springs.

As shown in FIG. 7, the conductive portion 19 has a first projection in the form of a ramp 34 upstream from its junction face 28*a* situated facing the first primary electrically-conductive stud 20*a*.

More precisely, that part of the side face of the conductive portion 19 that is situated directly upstream from the junction facet 28*a* diverges upstream over a length L4 measured along the axial direction X. In this example, the length L4 is selected to be substantially equal to the length L1 of the junction facets of the primary electrically-conductive studs, likewise measured along the axial direction X.

The conductive portion 19 also presents a second projection in the form of a ramp 38 formed downstream from the junction facets 28*a* and 28*b*. As shown in FIG. 7, when the slide 18 is in its first position, this second projection 38 is placed directly upstream from the downstream electrically-conductive stud 30. The length L5 of this ramp 38 (measured along the axial direction X) is substantially equal to the length L6 of the junction facet 31 of the downstream electrically-conductive stud 30 (measured along the axial direction X).

In the example shown, the conductive portion 19 also includes a setback 36 provided upstream of its junction facet 28*b* situated facing the second primary electrically-conductive stud 20*b*.

When the slide 18 is in its first position, the first projection 34 is situated upstream from the first primary electrically-conductive stud 20*a*, the setback 36 is situated upstream from the second primary electrically-conductive stud 20*b*, and the second projection 38 is situated upstream from the downstream electrically-conductive stud 30. The slide 18 is not in contact with the downstream electrically-conductive stud 30, which remains inactive.

When, under the effect of the pyrotechnic gas generator 16, the slide 18 moves downstream along the direction X, the first and second projections 34 and 38 become progressively clamped against the first primary electrically-conductive stud 20*a* and against the downstream electrically-conductive stud 30.

In parallel, the setback 36 is placed facing the junction facet 26*b* of the second electrically-conductive stud 20*b*.

In this position, the electrically-conductive studs 20*a* and 20*b* are no longer electrically connected together, so the first electric circuit is open. In contrast, the projections 34 and 38 clamping against the electrically-conductive studs 20*a* and 30 enable the conductive portion 19 to connect these two studs 20*a* and 30 electrically together, thereby closing a second electric circuit (branch circuit).

Advantageously, as can be seen in FIGS. 7 and 8, the cavity 14 is terminated in its downstream portion by a guide portion 32 of shape that is complementary to the shape of the bottom portion of the slide 18. The guide portion 32 serves to guide the slide 18 as it moves from its first position to its second position. In particular, it prevents the slide 18 from moving away from the first primary electrically-conductive stud 20*a* and from the downstream electrically-conductive stud 30, thereby increasing the reliability of the electrical contacts made in the second electric circuit (branch circuit) when the slide is in its second position.

As a variant, provision may also be made for the slide to be terminated at its bottom end by a conical portion for engaging as an interference fit in a corresponding conical cavity provided in the end wall 15 of the hollow body 12.

In the example described, the projections 34 and 38 of the conductive portion 19 are situated directly upstream from the junction facets 28*a*, 28*b*. As a variant, it is naturally possible for these projections to be situated upstream from these junction facets, but at a distance therefrom. Under such circumstances, the stroke traveled by the slide between its first and second positions merely becomes longer. Nevertheless, it is appropriate to take care that the distances between the projections and the junction facets with which they are to cooperate respectively remain substantially identical.

As mentioned above, the conductive portion 19 in the example described has a setback 36 situated upstream from the second primary electrically-conductive stud 20*b* when the slide 18 is in its first position. This setback enables electrical contact between the slide and the second conductive stud 20*b* to be broken when the slide travels along its stroke inside the cavity. Instead of having this setback, or as well as having it, the slide could include an insulating portion upstream from the junction facet 28*b*. The insulating portion should then be configured to be in register with the second primary electrically-conductive stud 20*b* once the slide 18 is in its second position.

In another advantageous example, the face of the slide that is situated facing the second primary electrically-conductive stud 20*b* may face downstream, as may the corresponding junction facet of the conductive stud 20*b*, thereby enabling the slide 18 to disengage immediately from the electrically-conductive stud 20*b* without being impeded by friction.

In yet another advantageous example, the downstream electrically-conductive stud may be urged towards the inside of the cavity 14 by resilient bias means, e.g. a spring. Under such circumstances, when the slide 18 moves from its first position towards its second position, the ramp 38 progressively stresses the downstream electrically-conductive stud in a direction that opposes the force of said resilient bias means. When the slide 18 is in its second position, the downstream electrically-conductive stud is urged into contact with the conductive portion 19 by said resilient bias.

Figure 11:
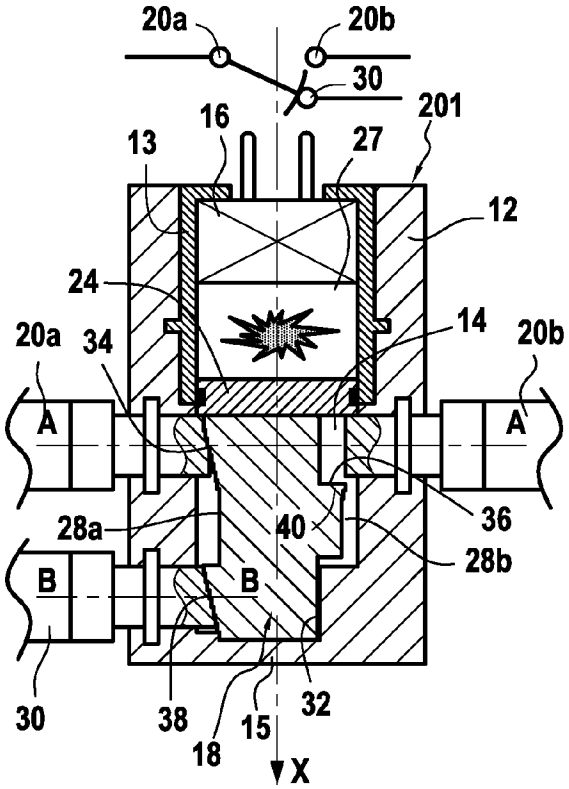
FIGS. 9 to 11 are lateral section views of an electric switch in a variant of the fourth embodiment of the invention shown respectively in its first position, in an intermediate position, and in its second position.
Figure 10:
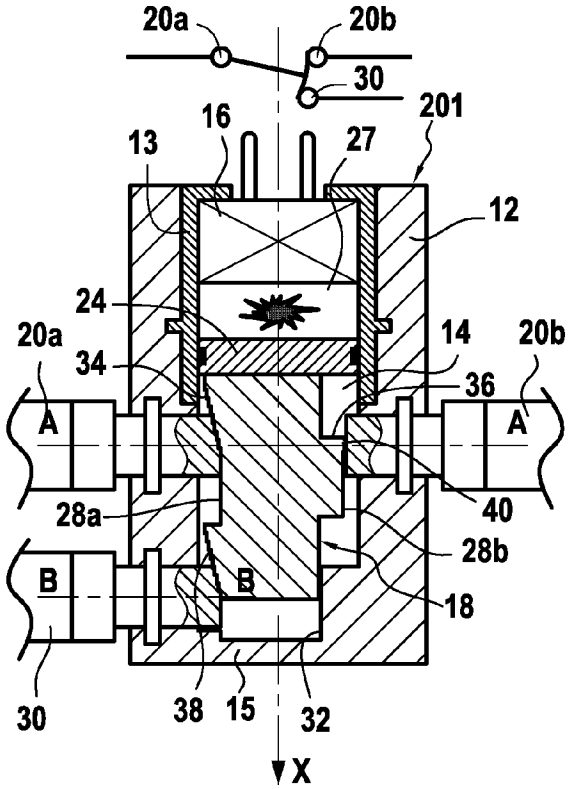
Figure 9:
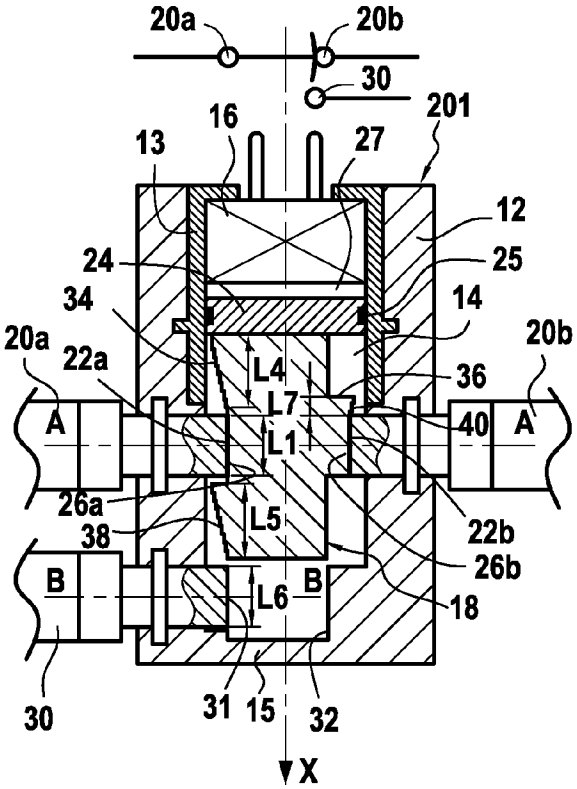

FIGS. 9 to 11 show an electric switch 201 in a variant of the fourth embodiment of the invention. All of the characteristics described above with reference to FIGS. 7 and 8 remain valid and are therefore not described again.

As shown in FIG. 9, the conductive portion 19 of the slide 18 has a third projection 40 situated in the vicinity of the setback 36. In particular, in this example, the projection 40 is positioned downstream from the setback 36 and upstream from the junction facet 28*b* of the conductive portion 19 that is connected to the second primary electrically-conductive stud 20*b*. This projection 40 presents an axial length L7 that is shorter than the lengths L4 and L5 of the first and second projections 34 and 38.

FIG. 10 shows the slide 18 in an intermediate position between its first and second positions.

In this intermediate position, the first and second projections 34 and 38 have begun to clamp respectively against the first electrically-conductive stud 20*a* and the downstream electrically-conductive stud 30. The third projection 40 is clamped against the second electrically-conductive stud 20*b*. Furthermore, the slide 18 is engaged in the guide portion 32.

All three electrically-conductive studs 20*a*, 20*b*, and 30 are thus mutually short-circuited and electricity begins to flow in the second electric circuit (branch circuit) connecting together the electrically-conductive studs 20*a* and 30 before the first electric circuit (connecting together the electrically-conductive studs 20*a* and 20*b*) is broken.

When the slide 18 reaches its second position, as shown in FIG. 11, the third projection 40 is downstream from the second electrically-conductive stud 20*b*, and the setback 36 is positioned facing the second electrically-conductive stud 20*b*.

In this position, the first electric circuit between the studs 20*a* and 20*b* is open and the second electric circuit between the studs 20*a* and 30 is closed.

Figure 14:
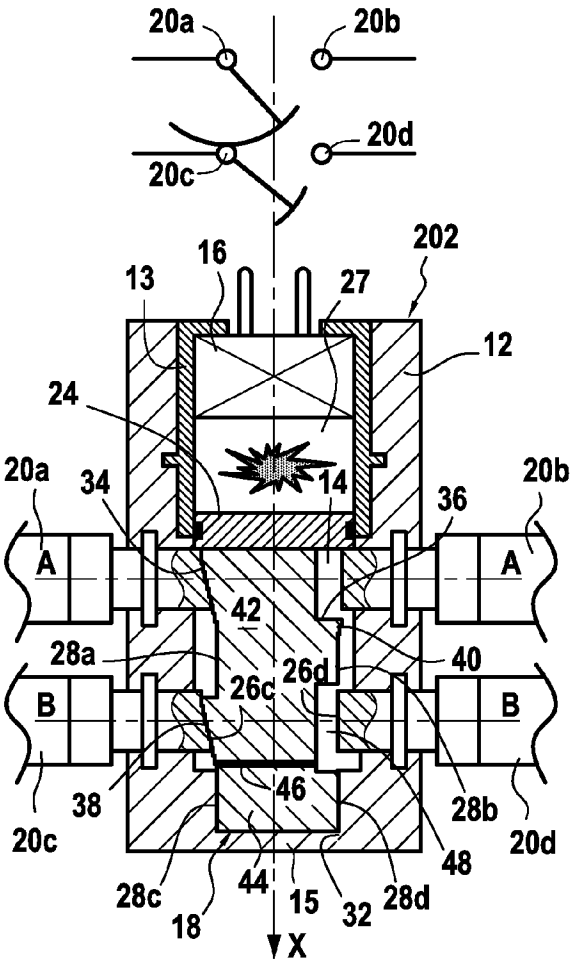
FIGS. 12 to 14 are section views of an electric switch in another variant of the fourth embodiment of the invention, shown respectively in its first position, in an intermediate position, and in its second position.
Figure 13:
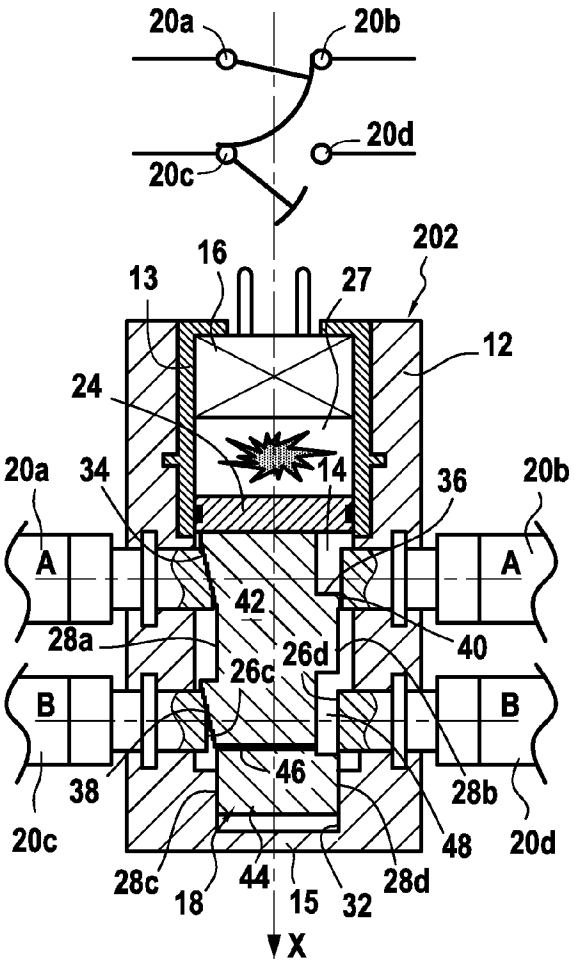
Figure 12:
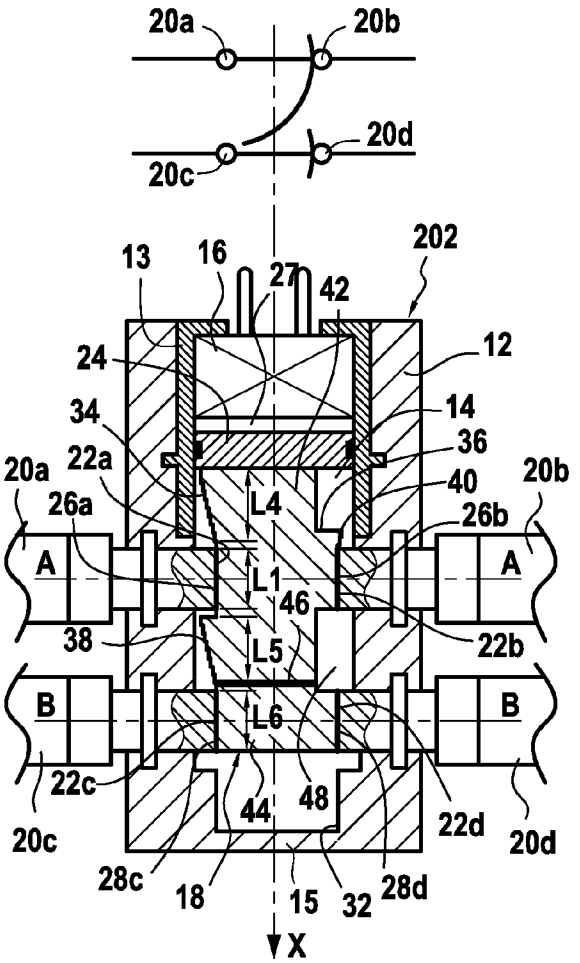

FIGS. 12 to 14 show an electric switch 202 in another variant of the fourth embodiment of the present invention, having a plurality of circuits that are initially connected in parallel.

In this variant, the switch 202 has a first pair of primary electrically-conductive studs 20*a* and 20*b*, and a second pair of primary electrically-conductive studs 20*c* and 20*d* that are situated downstream from said first pair 20*a*, 20*b*. In the example shown in the figures, the electrically-conductive studs of the first pair are defined along an axis A-A that is perpendicular to the axial direction X, and the electrically-conductive studs of the second pair 20*c*, 20*d* are situated on an axis B-B parallel to the axis A-A, and downstream therefrom.

As shown in FIGS. 12 to 14, the slide 18 has a first conductive portion 42 that is substantially identical to that described with reference to the above-described fourth embodiment and a second conductive portion 44 situated downstream from the first conductive portion 42. The two conductive portions 42 and 44 are separated from each other by insulation 46 that extends in a radial plane in this example.

When the slide 18 is in its first position, a junction facet 28*a* of the first conductive portion 42 is connected to a first primary electrically-conductive stud 20*a* of the first pair 20*a*, 20*b*, and a second junction facet 28*b* is connected to the second primary electrically-conductive stud 20*b* of the first pair 20*a*, 20*b*. In this example, the electrically-conductive studs of the first pair 20*a*, 20*b* are connected to the first conductive portion 42 by welds 22*a*, 22*b*.

The first conductive portion 42 of the slide 18 has a first projection 34 upstream from its junction facet 28*a*, and a second projection 38 situated upstream from the first primary electrically-conductive stud 20*c* of the second pair 20*c*, 20*d*.

These projections have a function that is identical to that of the projections described above with reference to FIGS. 7 and 8.

The second conductive portion 44 is situated facing the electrically-conductive studs 20*c* and 20*d* of the second pair. In this example, it has a first junction facet 28*c* connected by a weld 22*c* to the corresponding junction facet of the stud 20*c*, and a second junction facet connected by a weld 22*d* to the corresponding junction facet of the stud 20*d*.

In other embodiments, the bonds between the electrically-conductive studs and the conductive portions of the slide may be of any other type that provides a breakable permanent electrical junction. For example, these bonds may be obtained by brazing. In another example, the electrically-conductive studs and the conductive portions of the slide may be made as a single part, being mutually defined by break starters. In yet another example, the primary electrically-conductive studs may be urged into contact with the conductive portion by resilient bias means, e.g. springs.

In this example, it should be observed that the slide 18 has a first setback 36 upstream from its junction facet 28*b* connected to the second conductive stud 20*b* of the first pair, and a second setback 48 upstream from its junction facet 28*d* connected to the second electrically-conductive stud 20*d* of the second pair.

When the slide is in its initial position, as described above, the primary electrically-conductive studs 20*a* and 20*b* of the first pair are electrically connected together via the first conductive portion 42 of the slide 18, and the primary electrically-conductive studs 20*c*, 20*d* of the second pair are electrically connected together by the second conductive portion 44 of the slide 18.

The insulation 46 is placed upstream from the junction facets 28*c*, 28*d* of the slide 18 that are connected to the second pair of primary electrically-conductive studs 20*c*, 20*d*, and downstream from the second projection 38 and the second setback 48.

With this configuration, when the slide 18 reaches it second position, the first projection 34 clamps against the junction facet 26*a* of the first primary electrically-conductive stud 20*a* of the first pair 20*a*, 20*b*, and the second projection 38 clamps against the junction facet 26*c* of the first primary electrically-conductive stud 20*c* of the second pair 20*c*, 20*d*.

In parallel, the first setback 36 becomes positioned facing the junction facet 26*b* of the second primary electrically-conductive studs of the first pair 20*a*, 20*b*. In the same manner, the second setback 48 becomes positioned facing the junction facet 26*d* of the second primary electrically-conductive stud 20*d* of the second pair 20*c*, 20*d*.

Finally, as shown in FIG. 14, the insulation 46 lies downstream from the first primary electrically-conductive stud 20*c* of the second pair.

In this position, the electric circuit initially established between the electrically-conductive studs of the first pair 20*a*, 20*b* via the first conductive portion 42 of the slide 18 is open.

In the same manner, the electric circuit initially established between the electrically-conductive studs of the second pair 20*c*, 20*d* via the second conductive portion 44 of the slide 18 is open.

In contrast, a branch circuit is closed between the first electrically-conductive stud 20*a* of the first pair and the first electrically-conductive stud 20*c* of the second pair via the first conductive portion 42 of the slide.

In the example shown, the slide also has a third projection 40 that is shorter than the first and second projections 34 and 38 and that is situated upstream from its junction facet 28*b*, and downstream from the setback 36.

By moving from its first position to its second position under actuation by the pyrotechnic gas generator 16, the slide passes through an intermediate position shown in FIG. 13.

In this intermediate position, the first and second projections 34, 38 have begun to clamp respectively against the first primary electrically-conductive stud 20*a* of the first pair and the first electrically-conductive stud 20*c* of the second pair. The second electric stud of the second pair is no longer in contact with the second conductive portion 44. The third projection 40 is clamped against the second primary electrically-conductive stud 20*b* of the first pair. Finally, the slide 18 is engaged in the guide portion 32.

The three electrically-conductive studs 20*a*, 20*b*, and 20*c* are thus mutually short-circuited by the third projection 40, so electricity begins to pass along the second electric circuit (branch circuit) connecting together the electrically-conductive studs 20*a* and 20*c* before the first electric circuit (connecting together the primary electrically-conductive studs 20*a* and 20*b*) is broken.

The invention claimed is:

1. An electric switch, comprising:

a hollow body defining a cavity;

an actuator formed in said cavity;

a slide mounted in said cavity downstream from said actuator and including at least one conductive portion; and at least two primary electrically-conductive studs installed in the thickness of the hollow body and leading laterally into said cavity, wherein the conductive portion of the slide and the two primary electrically-conductive studs are electrically connected together when the slide is in a first position, thereby closing a first electric circuit, wherein, under actuation of the actuator, the slide is suitable for passing from its first position to a second position in which at least one of said primary electrically-conductive studs is no longer electrically connected to said conductive portion of the slide, and the connection between the conductive portion of the slide and the two primary electrically-conductive studs is a breakable permanent electrical junction constituted by a weld.

2. An electric switch, comprising:

a hollow body defining a cavity;

an actuator formed in said cavity;

a slide mounted in said cavity downstream from said actuator and including at least one conductive portion; and at least two primary electrically-conductive studs installed in the thickness of the hollow body and leading laterally into said cavity, wherein the conductive portion of the slide and the two primary electrically-conductive studs are electrically connected together when the slide is in a first position, thereby closing a first electric circuit, wherein, under actuation of the actuator, the slide is suitable for passing from its first position to a second position in which at least one of said primary electrically-conductive studs is no longer electrically connected to said conductive portion of the slide, and the connection between the conductive portion of the slide and the two primary electrically-conductive studs is a breakable permanent electrical junction constituted by a braze or solder joint.

3. An electric switch, comprising:

a hollow body defining a cavity;

an actuator formed in said cavity;

a slide mounted in said cavity downstream from said actuator and including at least one conductive portion comprising a first and a second junction facets; and a first and a second primary electrically-conductive studs installed in the thickness of the hollow body and leading laterally into said cavity, the first primary electrically-conductive stud comprising a third junction facet, and the second primary electrically-conductive stud comprising a fourth junction facet, the third and the fourth junction facets being adapted to be connected to the first or the second junction facets of the conductive portion by a breakable permanent electrical junction, wherein the first and the second junction facets of the conductive portion of the slide and the third and the fourth junction facets are electrically connected together when the slide is in a first position, thereby closing a first electric circuit, and wherein, under actuation of the actuator, the slide is suitable for passing from said first position to a second position in which the first or the second primary electrically-conductive studs is no longer electrically connected to said conductive portion of the slide, and the third and the fourth junction facets diverge downstream, and the first and the second junction facets of the conductive portion diverge downstream.

4. An electric switch, comprising:

a hollow body defining a cavity;

an actuator formed in said cavity;

a slide mounted in said cavity downstream from said actuator and including at least one conductive portion comprising a first and a second junction facets; and a first and a second primary electrically-conductive studs forming a first pair, and a downstream electrically-conductive stud arranged downstream from said first pair, the first primary electrically-conductive stud comprising a third junction facet, the second primary electrically-conductive stud comprising a fourth junction facet, and the downstream electrically-conductive stud comprising a fifth junction facet, the third and the fourth junction facets being adapted to be connected to the first or the second junction facet of the conductive portion by a breakable permanent electrical junction, wherein the first and the second electrically-conductive studs are installed in the thickness of the hollow body and lead laterally into said cavity, wherein when the slide is in a first position, the first and the second junction facets of the conductive portion of the slide are electrically connected to the third and the fourth junction facets, wherein the first junction facet faces the third junction facet, and the second junction facet faces the fourth junction facet, thereby closing a first electric circuit, wherein, under the action of the actuator, the slide is suitable for passing from said first position to a second position in which at least one of the first or the second primary electrically-conductive studs is no longer connected to the conductive portion of the slide, thereby opening the first electric circuit, and the conductive portion of the slide includes:

a first projection situated upstream from the first junction facet of the conductive portion connected to the first primary electrically-conductive stud when the slide is in said first position, and a second projection situated upstream from the downstream electrically-conductive stud when the slide is in said first position, wherein, when the slide is in said second position, the first projection is arranged to clamp against the third junction facet of the first primary electrically-conductive stud, and the second projection is arranged to clamp against the downstream electrically-conductive stud, thereby closing a second electric circuit.

5. The electric switch according to claim 4, wherein the breakable permanent electrical junction is a solder or braze joint.

6. The electric switch according to claim 4, wherein the breakable permanent electrical junction is a weld.

7. The electric switch according to claim 4, wherein the primary electrically-conductive studs and the conductive portion of the slide are made as a single part, but are mutually defined by break starters.

8. The electric switch according to claim 4, wherein, when the slide is in the first position, the downstream electrically-conductive stud is urged towards the inside of the cavity by resilient bias means, e.g. a spring, and when the slide is in the second position, the downstream electrically-conductive stud is urged into contact with the second projection by said resilient bias means.

9. The electric switch according to claim 4, wherein the primary electrically-conductive studs are situated facing each other on an axis perpendicular to the sliding direction of the slide.

10. The electric switch according to claim 4, wherein the actuator is a pyrotechnic gas generator, and the slide forms or is connected to a piston movable inside said cavity, an expansion chamber being defined between the actuator and said piston.

11. The electric switch according to claim 4, wherein the third and fourth junction facets diverge downstream and the first and the second junction facets of the conductive portion diverge downstream.

12. The electric switch according to claim 4, wherein the slide includes a setback upstream from the first or the second junction facet of the conductive portion.

13. The electric switch according to claim 4, wherein the slide includes an insulating portion upstream from the first or the second junction facet of the conductive portion.

14. The electric switch according to claim 4, wherein said cavity is terminated in a downstream portion by a guide portion, the guide portion is configured for guiding the slide as it passes from the first position to the second position.

15. The electric switch according to claim 4, wherein the slide also has a setback situated upstream from the second primary electrically-conductive stud when the slide is in the first position, and said setback is arranged to face the second primary electrically-conductive stud when the slide is in the second position, thereby opening the first electric circuit and closing the second electric circuit.

16. The electric switch according to claim 4, wherein the slide also includes an insulating portion situated upstream from the second primary electrically-conductive stud of the first pair when the slide is in the first position, and said insulating portion is arranged to face the second primary electrically-conductive stud of the first pair when the slide is in the second position, thereby opening the first electric circuit and closing a second electric circuit.

17. The electric switch according to claim 4, wherein the conductive portion further includes a third projection situated upstream from the second conductive stud of the first pair when the slide is in the first position, and shaped and dimensioned to clamp against the fourth junction facet of the second primary electrically-conductive stud when the slide is in an intermediate position between the first and second positions, and then to be positioned downstream from the second primary electrically-conductive stud when the slide is in the second position.

18. The electric switch according to claim 4, further comprising:

a second downstream electrically-conductive stud downstream from the first pair of primary electrically-conductive studs and co-operating with the downstream electrically-conductive stud to form a second pair, the second downstream electrically-conductive stud comprising a sixth facet, and wherein the slide includes at least first and second conductive portions that are separated from each other by insulation extending substantially in a radial plane of the slide, such that the first and the second primary electrically-conductive studs of the first pair are electrically connected together via the first conductive portion of the slide and the first and the second downstream electrically-conductive studs of the second pair are electrically connected together via the second conductive portion of the slide.

19. The electric switch according to claim 18, wherein the insulation is located upstream from the second pair and downstream from the second projection, whereby, when the slide is in the second position, the first projection is arranged to clamp against the third junction facet, and the second projection is arranged to clamp against the downstream electrically-conductive stud of the second pair.

20. The electric switch according to claim 18, wherein the slide further includes a second setback situated upstream from the second primary electrically-conductive stud of the second pair, and, when said slide is in the second position, the second setback is arranged to face the second downstream electrically-conductive stud of the second pair.

21. The electric switch according to claim 18, wherein the slide further includes a second insulating portion situated upstream from the second downstream electrically-conductive stud of the second pair and, when the slide is in the second position, said second insulating portion is arranged to face the sixth junction facet.

22. The electric switch according to claim 18, wherein the first pair and the second pair are situated respectively in planes perpendicular to the sliding direction of the slide.

23. The electric switch according to claim 22, wherein the insulation is located upstream from the second pair and downstream from the second projection, whereby, when the slide is in the second position, the first and second projections are arranged to clamp respectively against the third junction facet of the first electrically-conductive stud of the first pair and of the downstream electrically-conductive stud of the second pair.

* * * * *